United States Patent [19]

Sadegh

[11] Patent Number: 4,871,339

[45] Date of Patent: Oct. 3, 1989

[54] SPARK PLUG CRIMPING DIE AND PROCESS

[75] Inventor: Ali M. Sadegh, Closter, N.J.

[73] Assignee: General Motors Corporation, Detroit, Mich.

[21] Appl. No.: 240,287

[22] Filed: Sep. 6, 1988

[51] Int. Cl.[4] ..... H01T 21/02

[52] U.S. Cl. ..... 445/7; 72/352; 72/367

[58] Field of Search ..... 445/7; 29/34 R; 72/352, 72/367

[56] References Cited

U.S. PATENT DOCUMENTS

| | | | |
|---|---|---|---|
| 808,177 | 12/1905 | Thiem | 72/367 |
| 1,135,727 | 4/1915 | Schmidt . | |
| 1,193,075 | 8/1916 | Schmidt . | |
| 1,521,732 | 1/1925 | Thomas . | |
| 1,609,735 | 12/1926 | Rabezzana . | |
| 1,862,981 | 6/1932 | Rabezzana . | |
| 2,174,362 | 9/1939 | Doran | 123/169 |
| 2,308,968 | 1/1943 | Gregory | 219/3 |
| 2,357,110 | 8/1944 | Heineman | 72/352 |
| 2,437,205 | 3/1948 | Middleton et al. | 123/169 |

FOREIGN PATENT DOCUMENTS

| | | | |
|---|---|---|---|
| 0769573 | 8/1934 | France | 445/7 |
| 0736239 | 5/1980 | U.S.S.R. | 445/7 |

*Primary Examiner*—Kurt Rowan

*Attorney, Agent, or Firm*—Douglas D. Fekete

[57] ABSTRACT

A spark plug is manufactured by assembling an insulator body and an outer metal shell using an improved crimping die having a specially configured annular working face. The working face includes a flat, annular leading working surface configured to exert a substantial portion of the die force initially on an annular lip of the metal shell to plastically deform the lip inwardly onto an adjacent annular shoulder of the insulator body and a flat, annular trailing working surface configured to subsequently engage the lip and exert a substantial portion of the die force on the shoulder of the insulator body generally perpendicular to the shoulder to internally seal the insulator body and the metal shell by plastically compressing an annular gasket therebetween. The crimping die improves the distribution of the die force on the metal shell and the insulator body to reducew excessive deformation of the metal shell and to enhance compression of the sealing gasket for improved internal sealing purposes.

14 Claims, 21 Drawing Sheets

SPARK PLUG CRIMPING DIE AND PROCESS

FIELD OF THE INVENTION

The invention relates to the manufacture of spark plugs and, in particular, to the crimping and sealing of a metal spark plug shell and a ceramic spark plug insulator in such a manner as to reduce breakage of the insulator and reduce deformation of the metal shell as well as improve internal sealing of a deformable gasket therebetween.

BACKGROUND OF THE INVENTION

In the manufacture of a spark plug, a ceramic insulator body is positioned in a hollow metal shell and an annular end lip on the metal shell is crimped inwardly onto an adjacent annular shoulder on the insulator body to secure the insulator body and the metal shell together and also to move the insulator body in an axial direction to compress (plastically deform) an internal annular gasket positioned between the insulator body and the outer metal shell. The metal shell may include a reduced thickness section (referred to in the art as a "weld groove") disposed between the crimped lip and the internal seal. The weld groove typically is heated by suitable means, e.g., by electrical resistance heating, to an elevated temperature during or after the crimping operation. Upon cooling to ambient temperature after the crimping operation, the reduced thickness section of the metal shell contracts and imparts an increased sealing pressure on the deformed gasket by virtue of differences in the coefficient of thermal expansion between the assembled metal shell and the ceramic insulator body.

Crimping of the annular lip of the metal shell is typically effected by advancing a crimping die at a given die pressure or load axially along the shell and insulator body to plastically deform the lip while a stationary die supports the metal shell against movement at an outer annular seat on the shell (referred to in the art as the "engine seat"). In the past, a typical crimping die has included an annular working face which, when viewed along an axial cross-section, has a shape corresponding to a partial circle of a selected radius.

With the advent of high speed systems for manufacturing spark plugs wherein the "weld groove" is heated for a time on the order of three seconds prior to crimping of the annular lip of the metal shell and sealing of the shell and insulator body, problems with insufficient internal sealing and excessive deformation of the metal shell, especially at the "weld groove" and the "engine seat" thereof, have been encountered and have resulted in the production of unacceptable spark plugs.

There is a need to provide an improved crimping die as well as crimping process especially useful for the high speed production of spark plugs that overcomes these problems and results in a spark plug with acceptable internal sealing of the gasket between the insulator body and the outer metal shell and with deformation of the metal shell reduced within acceptable limits.

SUMMARY OF THE INVENTION

The invention contemplates an improved crimping die for use in the manufacture of spark plugs with acceptable internal sealing between the insulator body and outer metal shell without excessive deformation of the metal shell and breakage of the insulator body.

The crimping die of the invention includes an annular working face having (1) a flat, annular leading working surface inclined relative to the longitudinal axis of the spark plug to define an acute leading angle therebetween that is less than an acute angle defined between the annular shoulder of the insulator body and the longitudinal axis of the spark plug and that is selected to initiate crimping of the lip inwardly toward the annular shoulder as the crimping die and shell/insulator are relatively moved toward one another along the longitudinal axis and (2) a flat, annular trailing working surface inclined relative to the longitudinal axis to define an acute trailing angle therebetween that is generally equal to the acute angle defined by the annular shoulder so as to be substantially parallel to the annular shoulder as the crimping die and shell/insulator are relatively moved toward one another along the longitudinal axis to press the lip against the annular shoulder to complete crimping thereof and force the insulator body and metal shell together with the gasket deformed therebetween to effect internal sealing. The leading working surface and the trailing working surface provide an enhanced distribution of the overall die pressure initially to the deformable lip of the metal shell for improved crimping and then to the insulator body for improved internal sealing between the insulator body and the metal shell (by virtue of improved compression of the gasket). The extent of the overall die pressure applied to the metal shell is thereby reduced and reduces unwanted deformation of the metal shell and breakage of the insulator body during the crimping/internal sealing operation.

In a preferred embodiment of the invention, the leading working surface of the crimping die is inclined relative to the longitudinal axis to define an acute leading angle therebetween that is equal to or greater than one-half of the acute trailing angle but does not exceed about 30°. This preferred leading working surface provides initial engagement with the annular lip of the metal shell in such a manner that a substantial portion of the overall die pressure (force) effects plastic deformation of the lip rather than unwanted deformation of the metal shell.

The improved crimping die of the invention enables use of lower die pressures to assemble the metal shell and the insulator body without compromising effectiveness of the internal seal (compression of the gasket) between the insulator body and the metal shell.

In another preferred embodiment of the invention, the leading working surface and the trailing working surface of the crimping die are interconnected by a radiused intermediate working surface whose radius is substantially equal to the wall thickness of the annular lip of the metal shell before it is crimped.

The invention also contemplates a method of making a spark plug using the improved crimping die.

DETAILED DESCRIPTION OF THE INVENTION

Figure 1:
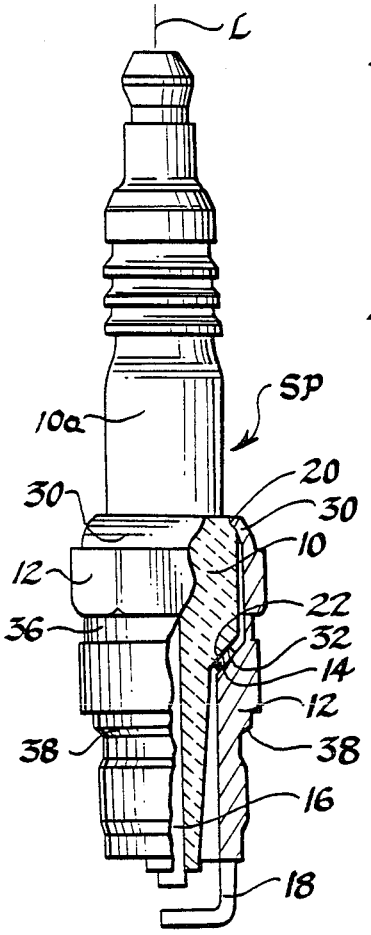
FIG. 1 is an elevational view, partially in cross-section, of spark plug components that are assembled in accordance with the method of the invention using the crimping die of the invention.
Figure 2:
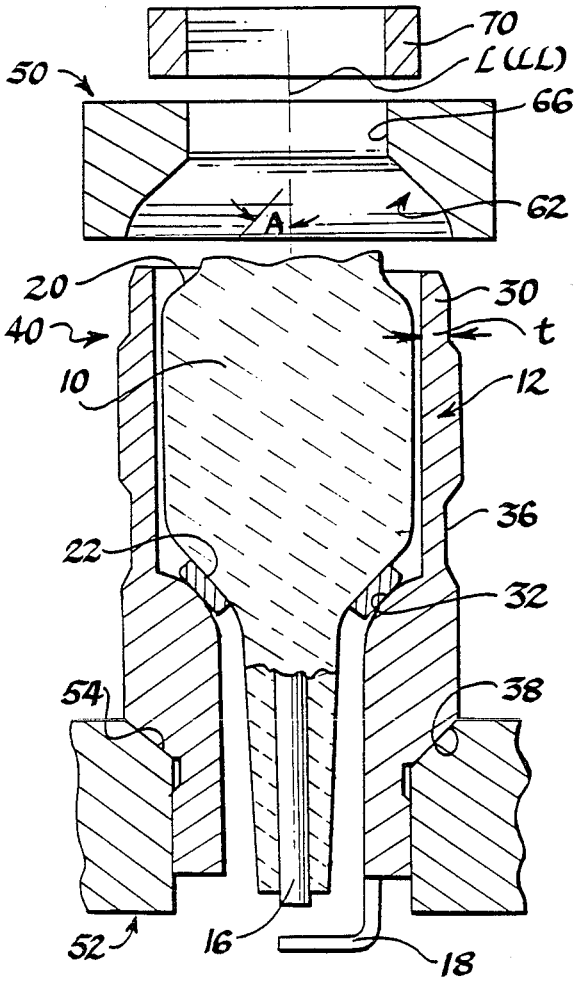
FIG. 2 is an enlarged cross-sectional view of a portion of the spark plug components of FIG. 1 showing a movable crimping die and stationary support die positioned relative to the spark plug components prior to the crimping/sealing operation.

Referring to FIGS. 1 and 2, a spark plug SP is assembled from an inner ceramic insulator body 10, an outer metal shell 12 and an annular, deformable sealing gasket 14 located between the insulator body 10 and the metal shell 12 as shown. Disposed in the insulator body 10 is a metal inner electrode 16 that cooperates with a side electrode 18 formed on the metal shell 12 in usual manner to generate a spark therebetween when a suitable electrical voltage is applied therebetween. The insulator body 10 includes a first, annular, flat, planar shoulder 20 that is inclined (chamfered) relative to the longitudinal axis L of the spark plug SP to define a first acute included angle A therebetween. In one embodiment of the invention, the included angle A is about 40°. The insulator body 10 also includes a second, annular, flat, planar shoulder 22 against which the sealing gasket 14 is sealingly seated, as will be explained hereinbelow.

The metal shell 12 initially includes an annular (cylindrical), deformable, upstanding lip 30 adjacent the first annular shoulder 20 of the insulator body 10 for crimping onto the first annular shoulder 20 as will be explained and a second, inner annular shoulder 32 disposed axially adjacent and spaced radially from the second annular shoulder 22 of the insulator body 10. As is apparent, the sealing gasket 14 is disposed between the second annular shoulders 22, 32 of the insulator body 10 and the metal shell 14, respectively.

The metal shell 12 also includes a first outer, annular groove 36 (a so-called weld groove) and an axially spaced apart second, outer annular shoulder 38 (a so-called engine seat).

In accordance with the method of the invention, the insulator body 10 is positioned inside the metal shell 12 with the upstanding, uncrimped lip 30 adjacent the first annular shoulder 20 of the insulator body 10 and with the sealing gasket 14 disposed between the second annular shoulders 22, 32 to form an uncrimped/unsealed spark plug assembly 40 shown in FIG. 2.

The assembly 40 is cooperatively positioned relative to a crimping/sealing apparatus that includes a movable, rigid crimping die 50 and a stationary, rigid support die 52, FIG. 2. The dies 50, 52 preferably are made of carbide (e.g., Kenanetal Grade 3109) to provide desired die rigidity (non-deformability). In particular, the stationary support die 52 includes an annular support surface 54 that supportingly engages the second outer, annular shoulder 38 (engine seat) of the metal shell 12 to prevent movement of the metal shell 12 as the movable crimping die 50 crimps the lip 30 onto the first annular shoulder 20 of the insulator body 10 and sealingly deforms the sealing gasket 14 between the second annular shoulders 22, 32.

Figure 3:
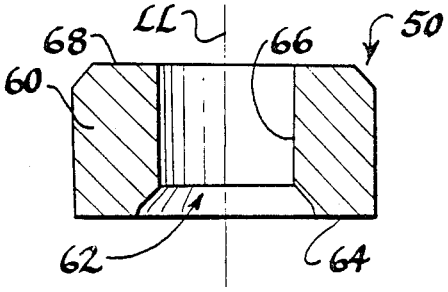
FIG. 3 is a longitudinal cross-sectional view of the movable crimping die.
Figure 4:
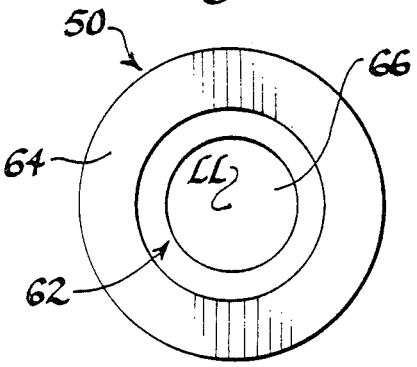
FIG. 4 is an end elevation of the movable crimping die of FIG. 3 showing the annular working face.
Figure 5:
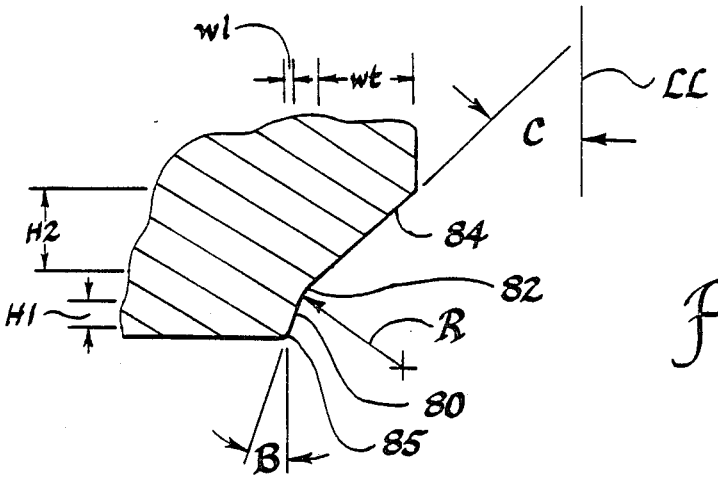
FIG. 5 is an enlarged cross-sectional view of the encircled portion of FIG. 3.

The movable crimping die 50 of the invention is shown in detail in FIGS. 3 through 5 as including a die body 60 having a longitudinal axis LL that, during the crimping/sealing operation, is aligned coaxially with the longitudinal axis L of the spark plug assembly 40. The die body 60 includes an annular working face 62 on the leading end 64 and a cylindrical bore 66 extending from the annular working face 62 to the trailing end 68 of the die body. The cylindrical bore 66 is configured to receive the upper end 10a of the insulator body 10 as the working face 62 crimps the lip 30 onto the first annular shoulder 20 and sealingly, deformably compresses the gasket 14 between the second annular shoulders 22, 32.

The annular working face 62 of the movable crimping die 50 is specially configured to initially transfer a majority of the die pressure or load to the deformable lip 30 to crimp the lip onto the first annular shoulder 20 and then subsequently to transfer a majority of the die load to the insulator body 10 itself to deformably compress the sealing gasket 14 between the second annular shoulders 22, 32. The die load is applied to the crimping die 50 by a hydraulic piston 70 (shown schematically) or other force-applying device engaged with the crimping die 50. The piston 70 moves the crimping die 50 toward the assembly 40 along the longitudinal axis L, LL which, as mentioned, are coaxial during the crimping-/sealing operation.

More specifically, the annular working face 62 includes a flat, planar, annular leading working surface 80, radiused intermediate working surface 82, and a flat, planar, annular trailing working surface 84, FIG. 5.

The flat, planar leading working surface 80 is inclined (chamfered) relative to the longitudinal axis LL of the die body to define an acute leading angle B therewith while the flat, planar trailing working surface 84 is also inclined (chamfered) relative to the longitudinal axis LL to define an acute trailing angle C therewith.

Importantly, the leading angle B is selected to be about equal to or greater than one-half of the trailing angle C but not to exceed 30°. Moreover, the height H1 of the leading working surface 80 is selected to be about ¼ or less of the height H2 of the trailing working surface 84, FIG. 5.

The outer diameter of the leading working surface 80 is preferably greater than the total of the outer diameter of the lip 30 plus 1½ times the wall thickness t of the uncrimped lip 30. The width w1 of the leading working surface 80 preferably is about ⅓ times the wall thickness t of the uncrimped lip 30.

Figure 6:
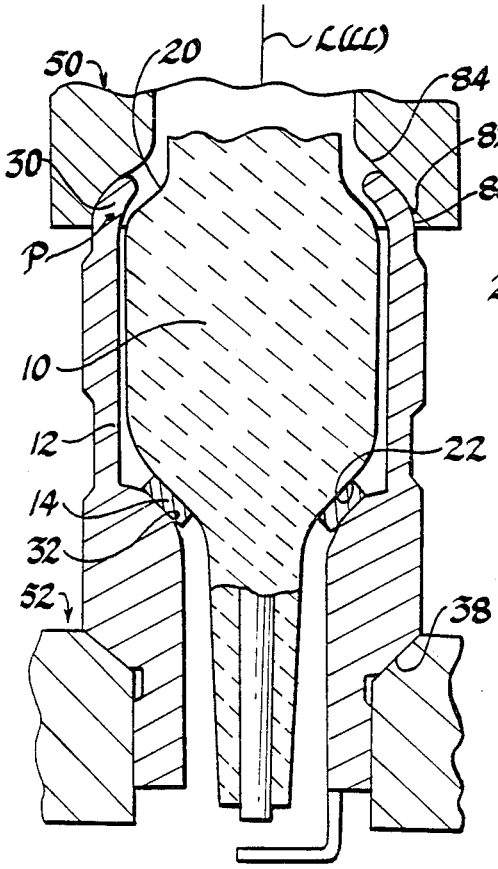
FIG. 6 is a partial longitudinal cross-sectional view of the spark plug and dies during the initial crimping part of the method of the invention.

The configuration of the leading working surface 80 is selected to initiate rotation of the lip 30 at points P on the shell cross section (FIG. 6) such that the area of contact between the lip 30 and the first annular shoulder 20 is increased and a majority (e.g., at least 80 percent) of the die pressure is transferred to the lip 30 to plastically deform and crimp same inwardly onto the annular shoulder 20 of the insulator body. In this way, the configuration of the leading working surface 80 reduces plastic deformation of other portions (such as the weld groove 36 and engine seat 38) of the metal shell 12 during the initial stages of the crimping/sealing operation. Faster crimping of the lip 30 onto the first annular shoulder 20 also results.

A small radius surface 85 interconnects the leading end 64 of the die body 60 and the leading working surface 80 to provide clearance for the lip 30 of the metal shell 12 as the die 50 is moved into engagement therewith.

Also importantly, the trailing angle C is substantially equal to the first acute angle A defined between the first annular shoulder 20 and the longitudinal axis L such that the trailing working surface 84 is generally parallel to the first annular shoulder 20 as the crimping die 50 is moved along axes L, LL during the crimping/sealing operation. For purposes of illustration, the trailing angle C is selected in the range of about 40° to about 47°, preferably about 41° to about 45°, when the acute angle A is about 40°. Most preferred is a trailing angle of about 41° when the acute angle A is about 40°. The slight difference between the angles A and C is present to accommodate typical manufacturing tolerances associated with the first annular shoulder 20 of the insulator body 10.

As will be explained hereinbelow, by making the trailing angle C generally equal to the first acute angle A (i.e., the trailing working surface 84 is generally parallel to the first annular shoulder 20), a majority of the die load is transferred to the insulator body 10 (instead of to the metal shell 12) after the lip 30 is crimped to maximize axial load on the insulator body 10 to seal the gasket 14. In particular, a majority of the die load is transferred to the annular shoulder 20 through the crimped lip 30 in a direction perpendicular to the shoulder 20 (i.e., a normal component of the die pressure is transferred to the shoulder 20). If the trailing angle C is substantially greater than the first acute angle A, then the majority of die load will be transferred to the metal shell 12 (rather than to the insulator body 10) and result in unwanted, excessive deformation of the lower portion of the metal shell 12, in particular, at the weld groove 36 and engine seat 38 of the metal shell 12. On the other hand, if the trailing angle C is substantially less than the acute angle A, then the load on the insulator body 10 (through engagement with first annular shoulder 20 thereof) will be directed perpendicular to axis LL and may damage the insulator body.

The outer diameter of the trailing working surface 84 is slightly less than the outer diameter of the lip 30 and preferably is about two times the wall thickness t of the uncrimped lip 30. The width wt of the trailing working surface 84 preferably is about 3½ times the wall thickness t of the uncrimped lip 30.

The intermediate, radiused working surface 82 interconnects the leading working surface 80 and the trailing working surface 84 and has a radius R preferably substantially equal to two times the wall thickness t of the uncrimped lip 30. The radiused working surface 82 is configured to provide a smooth transition in the bending (deforming) of the lip 30 onto the first annular shoulder 20 of the insulator body 10, FIG. 6.

Figure 7:
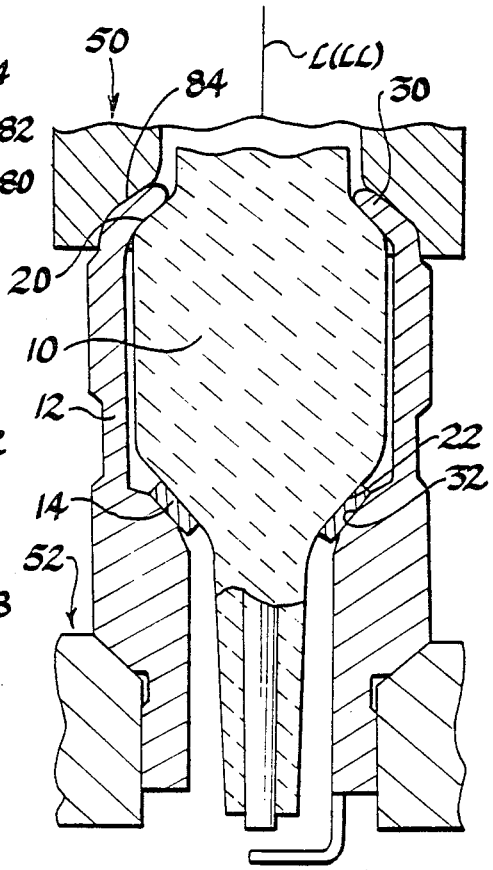
FIG. 7 is similar to FIG. 6 during the final sealing part of the method of the invention.

In accordance with the method of the invention, after the assembly 40 is first cooperatively positioned relative to the stationary die 52 as shown in FIG. 2, the metal shell 12 is inductively heated for about three seconds to about 1000° F. (temperature profile measurements indicate 1050° F. at the weld groove 36 and about 950° F. at the lip 30). The hydraulic piston 70 is then actuated to move the crimping die 50 rapidly along the longitudinal axes L, LL (1) to initially engage the lip 30 with the leading working surface 80 and intermediate working surface 82 in succession, FIG. 6, to initially crimp the lip 30 over and onto the first annular shoulder 20 and (2) then to engage the lip 30 with the trailing working surface 84 to complete the crimping of the lip 30 in sealing contact on the first annular shoulder 20 and to force the insulator body 10 axially within the metal shell 12 to deformably compress the gasket 14 between the second annular shoulders 22, 32, FIG. 7. In FIG. 7, it is apparent that a relatively large contact area is provided between the trailing working surface 84 and the annular shoulder 20 to enhance uniformity of distribution of die pressure on the shoulder 20.

During plastic deformation of the lip 30 by successive engagement with the leading working surface 80 and the intermediate working surface 82, a majority of the total die pressure deforms the lip 30 onto the first annular shoulder 20, rather than axially to the metal shell 12. This minimizes deformation of the metal shell 12, especially the weld groove 36 and the engine seat 38. During final crimping of the deformed lip 30 into sealing contact on the first annular shoulder 20 and compression of the gasket 14 into sealing engagement between the second annular surfaces 22, 32, the die pressure (i.e., a component of the die pressure normal to the annular shoulder 20) is transferred to the insulator body 10 in such a manner as to maximize axial load thereon for sealingly deforming the gasket 14, rather than axially deforming the metal shell 12.

In one example of the method of the invention for assembling a spark plug using a die pressure of 5.5 tons exerted on the movable crimping die 50, the deformation (reduction in thickness) of the sealing gasket 14 was observed to be about 0.007 to 0.009 inch. This compares to a deformation (reduction in thickness) of only 0.002 to 0.004 inch at a die pressure of 6.25 tons using a prior art crimping die having an annular working face in the shape of a quarter circle of 0.078 inch radius. The method of the invention using the crimping die 50 of the invention produced 160 percent more deformation of the sealing gasket using 12 percent less die pressure. Since greater gasket deformation translates to better internal sealing between the insulator body 10 and the metal shell 12, the crimping die and process of the invention can provide improved internal sealing of the spark plug with less die load on the crimping die.

The present invention thus enables the manufacture of spark plugs having improved internal sealing (better compression of gasket 14) and minimized deformation of the metal shell 12. Moreover, the invention provides reduced breakage of the insulator body 10 by virtue of reduced die pressure required for gasket sealing as well as more uniform distribution of the die pressure on the insulator body 10.

While certain specific and preferred embodiments of the invention have been described in detail hereinabove, those skilled in the art will recognize that various modifications and changes can be made therein within the scope of the appended claims which are intended to include equivalents of such embodiments.

The embodiments of the invention in which an exclusive property or privilege is claimed are defined as follows:

1. A crimping die for crimping a generally cylindrical, hollow metal shell to secure an insulator body assembled therein by relative movement of said die and said metal shell together along a longitudinal axis such that said die engages an annular lip of the metal shell and deforms the lip inwardly against a flat annular shoulder of the insulator body, said insulator body shoulder being inclined relative to the longitudinal axis to define a first acute angle therebetween, comprising:

a die body having an annular working face defined about the longitudinal axis, said annular working face including (a) a flat, annular leading working surface inclined relative to the longitudinal axis to define an acute leading angle therebetween less than said first acute angle to initiate crimping of the lip inwardly toward the annular shoulder and (b) a flat, annular trailing working surface inclined relative to the longitudinal axis to define an acute trailing angle therebetween generally equal to said first acute angle so as to press the lip substantially parallelly against the shoulder to complete crimping thereof.

2. The crimping die of claim 1 wherein the leading angle is about equal to or greater than one-half of the trailing angle but does not exceed about 30°.

3. The crimping die of claim 1 wherein the trailing angle is about 40° to about 47°.

4. The crimping die of claim 3 wherein the trailing angle is about 41° to about 45°.

5. The crimping die of claim 1 wherein the annular working face further includes a radiused intermediate working surface between the leading working surface and the trailing working surface.

6. The crimping die of claim 5 wherein the intermediate working surface is defined by a radius substantially equal to two times the wall thickness of the lip before crimping thereof.

7. A crimping die for crimping a generally cylindrical, hollow metal shell to secure an insulator body assembled therein by relative movement of said die and said metal shell together along a longitudinal axis such that said die engages an annular lip of the metal shell and deforms said lip inwardly against a flat annular shoulder of an insulator body, said insulator body shoulder being inclined relative to the longitudinal axis to define about a 40° angle therebetween, comprising:

a die body having an annular working face defined about the longitudinal axis, said annular working face including a flat, annular leading working surface inclined relative to the longitudinal axis to define an acute leading angle therebetween of about 20° to initiate crimping of the lip inwardly toward the annular shoulder and further including a flat, annular trailing working surface inclined relative to the longitudinal axis to define an acute trailing angle therebetween of about 40° to about 47° to press the lip against the shoulder to complete crimping thereof.

8. A method of making a spark plug by crimping and internally sealing a metal shell and an insulator body in the metal shell, comprising:

(a) forming an assembly having the insulator body disposed in the metal shell including (1) positioning a flat, annular shoulder of the insulator body and an annular, deformable lip on the metal shell adjacent one another with said annular shoulder inclined at a first acute angle relative to the longitudinal axis of the spark plug and (2) positioning an annular, axially deformable gasket between the insulator body and the metal shell remote from said insulator body shoulder, and (b) relatively moving the assembly and a crimping die along the longitudinal axis of the spark plug to (1) initially engage the lip with a flat, annular leading die working surface inclined at an acute leading angle relative to said longitudinal axis less than said first acute angle to initially plastically deform the lip inwardly onto the annular shoulder and (2) subsequently engage the lip with a flat, annular trailing die working surface inclined at an acute trailing angle relative to said longitudinal axis generally equal to said first acute angle so as to be oriented generally parallel to the annular shoulder to complete the crimping of the lip thereon and force the insulator body against the gasket to plastically deform and seal same between said insulator body and said metal shell.

9. The method of claim 8 including configuring said leading working surface such that said acute leading angle is about equal to or greater than one-half of the acute trailing angle but not exceeding about 30°.

10. The method of claim 8 including engaging said lip with a radiused working surface on said die disposed between said leading working surface and said trailing working surface.

11. The method of claim 8 wherein the crimping die is advanced along the longitudinal axis toward the assembly while the metal shell is held stationary.

12. The method of claim 8 wherein the annular shoulder of the insulator body is configured to define a first acute angle of about 40° relative to said longitudinal axis.

13. The method of claim 12 wherein the acute trailing angle is about 40° to about 47°.

14. The method of claim 13 wherein the acute leading angle is about 20°.

* * * * *